US007228854B1

(12) United States Patent
Iwa et al.

(10) Patent No.: US 7,228,854 B1
(45) Date of Patent: Jun. 12, 2007

(54) IGNITION COIL APPARATUS FOR AN INTERNAL COMBUSTION ENGINE

(75) Inventors: Masahiro Iwa, Tokyo (JP); Nobuyuki Sawazaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/447,886

(22) Filed: Jun. 7, 2006

(30) Foreign Application Priority Data

Jan. 31, 2006 (JP) ..... 2006-022571

(51) Int. Cl.
*F02P 13/00* (2006.01)
*H01F 27/28* (2006.01)

(52) U.S. Cl. ..... 123/634

(58) Field of Classification Search ..... 123/634, 123/635

See application file for complete search history.

(56) References Cited

U.S. PATENT DOCUMENTS 5,703,556 A * 12/1997 Kikuta et al. ..... 336/83
5,778,863 A * 7/1998 Oosuka et al. ..... 123/634
6,208,231 B1 * 3/2001 Oosuka et al. ..... 123/634
2005/0241627 A1 * 11/2005 Ward ..... 123/634

FOREIGN PATENT DOCUMENTS

JP 11-022604 A 1/1999

* cited by examiner

*Primary Examiner*—Erick Solis
(74) *Attorney, Agent, or Firm*—Sughrue Mion, PLLC

(57) ABSTRACT

An ignition coil apparatus for an internal combustion engine can improve the ignition performance of the engine in an entire rotation range. The ignition coil apparatus is arranged in a plug hole formed in the engine, and includes a case (1), a center core (2) arranged on a central axis of the case (1), and a primary coil (3) and a secondary coil (4) both arranged on an outer periphery of the center core (2). Magnets (20) are arranged on the opposite end faces, respectively, of the center core (2) for applying a magnetic force thereto in a direction opposite to the direction of magnetic flux lines generated when a primary current ($i_1$) is supplied to the primary coil (3), and the primary coil (3) has a resistance, an upper limit value of which is 1.2 Ω.

5 Claims, 7 Drawing Sheets

IGNITION COIL APPARATUS FOR AN INTERNAL COMBUSTION ENGINE

BACKGROUND OF THE INVENTION

1. Field of the Invention

The present invention relates to an ignition coil apparatus for an internal combustion engine that is arranged in a plug hole of the internal combustion engine.

2. Description of the Related Art

In the past, as an ignition coil apparatus for an internal combustion engine of so-called full transistor type (hereinafter simply referred to as an ignition coil apparatus) that is arranged in a plug hole, there has been known one which is capable of reducing the consumption of electric power in a primary winding by decreasing the resistance value of the primary winding thereby to supply a large amount of primary current to a primary coil so as to make quicker or faster the rising of the primary current (see, for example, a first patent document: Japanese patent application laid-open No. H11-22604).

In the ignition coil apparatus as constructed above, ignition performance can be improved by reducing the resistance value of the primary coil and increasing the value of an interruption current in a high rotation number region of the engine, but the cross-sectional area of a center core of the ignition coil can not be increased to a satisfactory extent since the center core is arranged in the elongated plug hole. As a result, magnetic saturation occurs in the center core, so the effective inductance of the primary coil is reduced, thus giving rise to a problem that ignition performance can not be improved in a low rotation number region of the engine.

SUMMARY OF THE INVENTION

Accordingly, the present invention is intended to obviate the problem as referred to above, and has for its object to obtain an ignition coil apparatus for an internal combustion engine which is improved in its ignition performance over an entire rotation range.

Bearing the above object in mind, according to the present invention, there is provided an ignition coil apparatus for an internal combustion engine which is arranged in a plug hole formed in the internal combustion engine, the apparatus including a case, a center core arranged on a central axis of the case, and a primary coil and a secondary coil both arranged on an outer periphery of the center core. A magnet is arranged on at least one of opposite end faces of the center core for applying a magnetic force thereto in a direction opposite to the direction of magnetic flux lines generated when a primary current is supplied to the primary coil, and the primary coil has a resistance, an upper limit value of which is 1.2 Ω.

According to the ignition coil apparatus for an internal combustion engine of the present invention as constructed above, it is possible to improve the ignition performance of the engine in the entire rotation range.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENT

Hereinafter, a preferred embodiment of the present invention will be described in detail while referring to the accompanying drawings.

Embodiment 1

Figure 1:
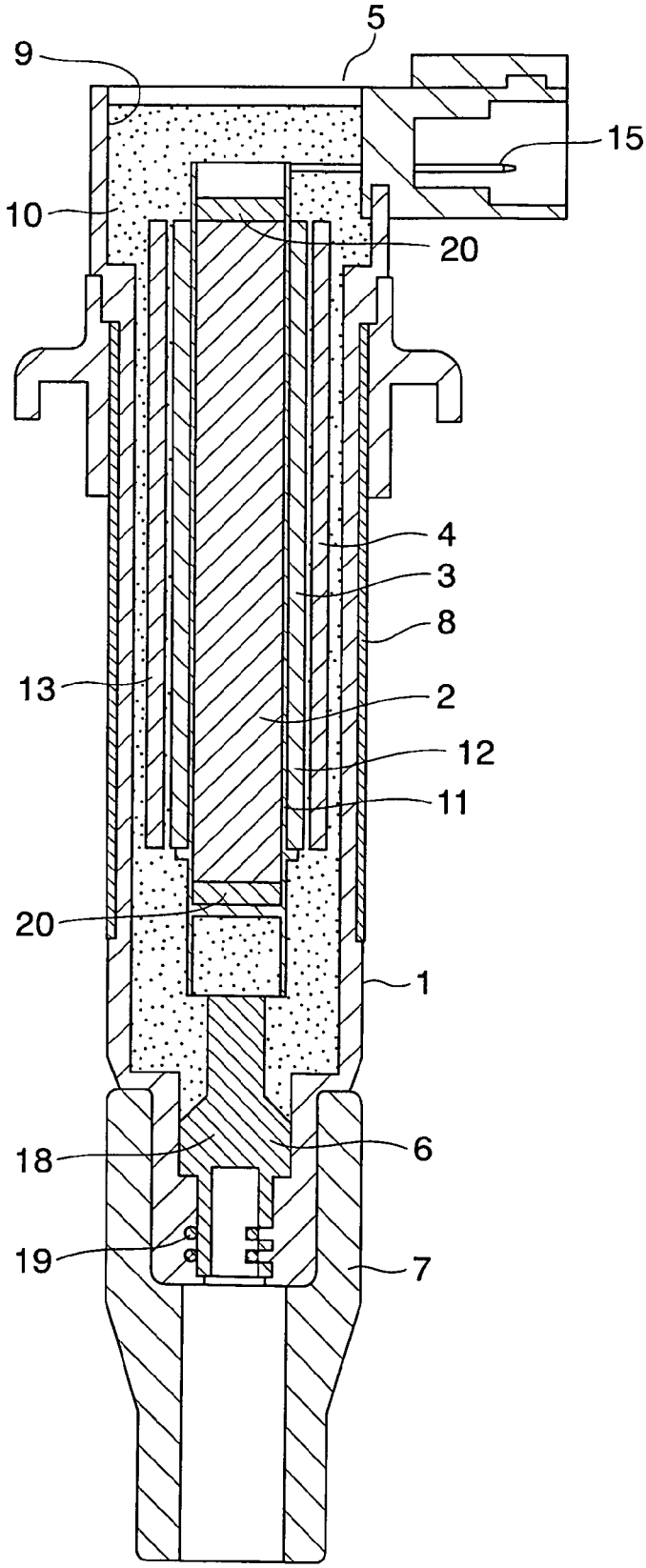
FIG. 1 is a cross sectional view showing an ignition coil apparatus for an internal combustion engine according to a first embodiment of the present invention.
Figure 2:
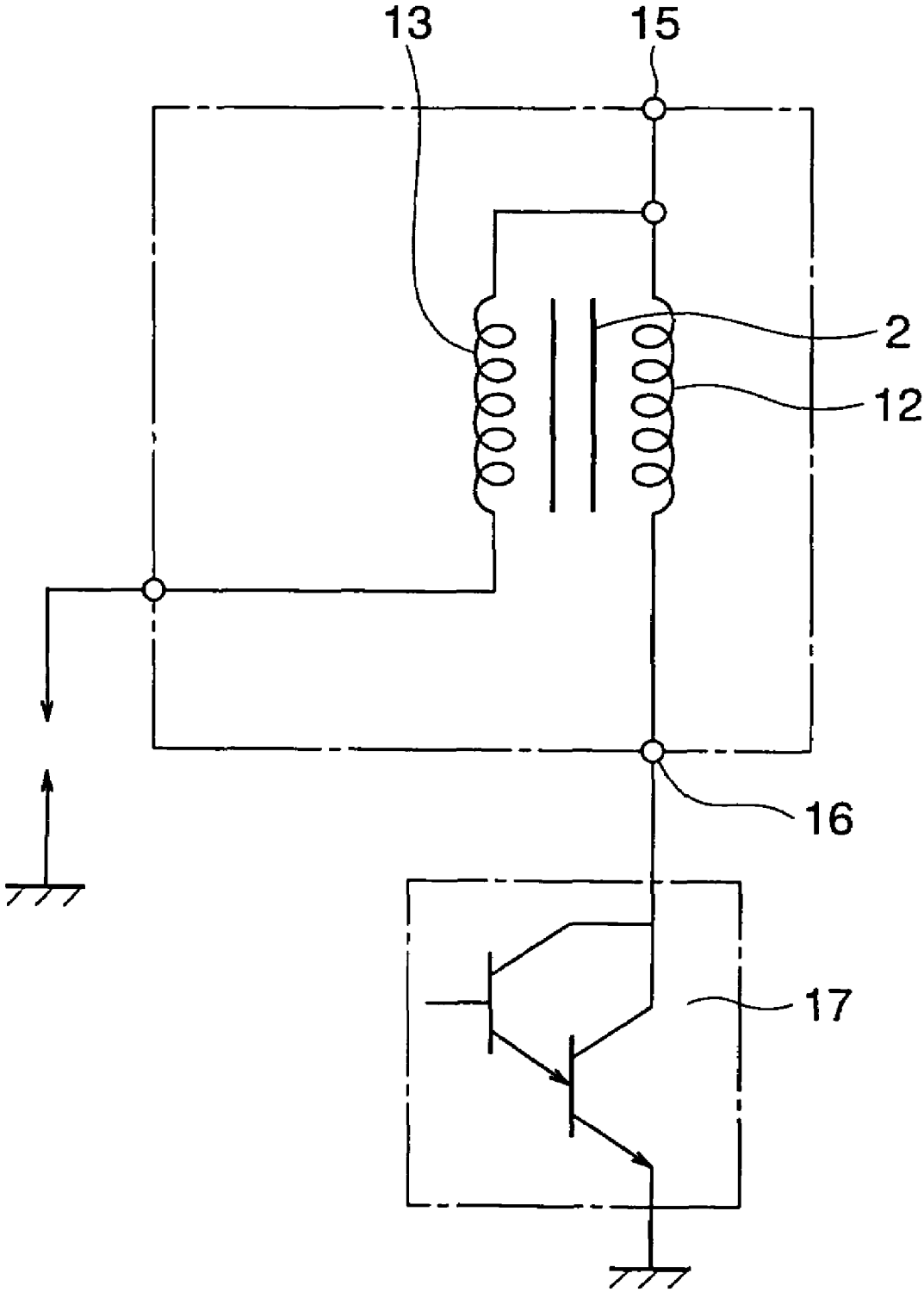
FIG. 2 is an electric circuit diagram of the ignition coil apparatus shown in FIG. 1.

FIG. 1 is a cross sectional view of an ignition coil apparatus for an internal combustion engine (hereinafter abbreviated as an ignition coil apparatus) according to a first embodiment of the present invention, and FIG. 2 is an electric circuit diagram of the ignition apparatus for an internal combustion engine shown in FIG. 2.

In this ignition coil apparatus, a column-shaped center core 2 is arranged in a case 1 of a bottomed cylindrical shape, and the center core 2 extends along and on the central axis of the case 1, and is formed of laminated or stacked strip-shaped silicon steel sheets. A primary coil 3 and a secondary coil 4 are arranged on the outer periphery of the center core 2 in a concentric relation. A low-tension side connector 5 electrically connected to the primary coil 3 is arranged at an upper portion of the case 1, and a high-tension side connector 6 electrically connected to a spark plug (not shown) is arranged at a lower portion of the case 1.

A pair of disk-shaped magnets 20 are arranged in abutment with an upper end face and a lower end face, respectively, of the center core 2. The magnets 20 are magnetized so as to apply a magnetic force to the center core 2 in a direction opposite to the direction of the magnetic flux lines generated when a primary current is supplied to the primary coil 3. Here, note that a single magnet 20 may be provided on either one of the upper end face and the lower end face of the center core 2.

An elastic cap 7, being press-fitted into the inner wall surface of a plug hole having an internal diameter of 4 mm (not shown) in the internal combustion engine, is arranged at an end of the case 1.

An outer layer core 8, which forms a closed magnetic circuit together with the center core 2, is arranged on the outer peripheral side wall surface of the case 1.

The center core 2, the primary coil 3, the secondary coil 4, the high-tension side connector 6 and so on are built into the case 1, and after the low-tension side connector 5 is fitted into an opening portion 9 of the case 1, an insulating material 10 composed of an epoxy resin before thermally set is filled into the case 1, and it is thermally set at a high temperature.

The primary coil 3 has a primary bobbin 11 of a bottomed cylindrical shape, and a primary winding 12 that is formed of a conducting wire in the form of an enameled wire wound around the primary bobbin 11.

The secondary coil 4 has a secondary bobbin of a cylindrical shape (not shown), and a secondary winding 13 that is formed of a conducting wire in the form of an enameled wire wound around the secondary bobbin.

The low-tension side connector 5 has a positive side terminal 15 that is electrically connected to a battery (not shown), and a negative side terminal 16 that is electrically connected to a control circuit part 17 including a power transistor for controlling the energization of the primary winding 12. The control circuit part 17 is separately arranged outside of the case 1.

The high-tension side connector 6 has a high-tension side connector main body 18, and a C-shaped resilient wire material 19 that is arranged on a peripheral wall surface of this high-tension side connector main body 18 at a spark plug (not shown) side for applying a resilient force to an inner diameter side thereof.

The conductor of the primary winding 12 has one end portion thereof electrically connected to the positive side terminal 15 of the low-tension side connector 5, and the other end portion thereof electrically connected to the control circuit part 17 through the negative side terminal 16 of the low-tension side connector 5.

The conductor of the secondary winding 13 has one end portion thereof electrically connected to the positive side terminal 15 of the low-tension side connector 5, and the other end portion thereof electrically connected to the high-tension side connector 6 that is connected to the spark plug.

In the ignition coil apparatus according this first embodiment, when a primary current is supplied from the battery to the primary winding 12 through the positive side terminal 15 of the low-tension side connector 5, the center core 2 is magnetized whereby magnetic energy is accumulated in the primary coil 3, and a magnetic field is generated in the surroundings thereof.

Under such a condition, when the primary current supplied to the primary winding 12 is interrupted by the operation of the control circuit part 17, the magnetic field is changed whereby a reverse voltage is generated in the primary winding 12 by the self-induction operation thereof, and a high voltage is generated in the secondary winding 13 under mutual induction between the primary and secondary windings 12, 13. In this case, the magnetic energy accumulated at the primary winding 12 side is released to the secondary winding 13 side.

However, the primary coil side magnetic energy accumulated in the primary coil 3 when the primary current is supplied to the primary winding 12 is obtained by the following expression.

$$E_1=(1/2)\times L_1\times(i_1)^2 \quad (1)$$

where $E_1$ represents the magnetic energy accumulated in the primary coil 3; $L_1$ represents the inductance of the primary coil 3; and $i_1$ represents the primary current supplied to the primary winding 12.

From expression (1) above, it is found that the inductance $L_1$ and the primary current $i_1$ need be made large so as to obtain a large amount of magnetic energy $E_1$.

In order to make the inductance $L_1$ to a large value, there is a method of increasing the cross-sectional area of the center core 2, the number of turns of the conductor of the primary coil 3 or the like. However, adoption of such a method directly leads to an increase in the diametral size or dimension of the ignition coil apparatus, so there is a limitation to the application of such a method to a full transistor type ignition coil apparatus.

On the other hand, in the ignition coil apparatus of the full transistor type, the cross-sectional area of the center core 2 is small, and hence, when the primary current $i_1$ is made large, magnetic saturation is generated, thereby reducing the effective inductance $L_1$.

In this embodiment, the magnets 20 are arranged in abutment with the upper end face and the lower end face, respectively, of the center core 2, and the magnets 20 are magnetized so as to apply a magnetic force to the center core 2 in the direction opposite to the direction of the magnetic flux lines generated when the primary current is supplied to the primary winding 12. With such an arrangement, it is possible to prevent magnetic saturation in a large current region without increasing the cross-sectional area of the center core 2 or the number of turns of the conductor of the primary winding 12, and also prevent the reduction of the inductance $L_1$ in an actual use region as well.

In addition, the primary current $i_1$ is obtained by the following expression.

$$i_1(t)=V_B/R_1\times(1-\exp(-R_1/L_1\times t)) \quad (2)$$

where t represents the current supply time duration of the primary coil 3; $V_B$ represents the voltage of the power supply (battery voltage); and $R_1$ represents the resistance of the primary winding 12.

Also, the electric power consumption P of the primary coil 3 is represented by the following expression.

$$P=R_1\times\int(i_1)^2dt \quad (3)$$

The Joule heat generated in the primary winding 12 is reduced when the resistance $R_1$ of the primary winding 12 is small, so in the high rotation number region (the on and off period of energization of the primary coil 3 is short), it is necessary to shorten the on time so as to ensure the off time. Since the rising of the primary current is quick or fast when the resistance $R_1$ is small, a high current value can be reached even in a short on time, so it is possible to interrupt the primary current at a high current value.

In the low rotation number region (the on and off period of energization of the primary coil 3 is long), a sufficient off time is ensured, so the on time can be increased, and a maximum primary current value obtained by Ohm's law ($V_B=i_1\times R_1$) can accordingly be increased, thereby ensuring a high interruption current value.

From the above, by reducing the resistance $R_1$ of the primary winding 12 and using the magnets 20, it is possible to improve the ignition performance of the ignition coil apparatus while keeping the consumption of electric power (heat generation) thereof equivalent to that of a conventional ignition coil apparatus in comparison therewith.

The inventor conducted experiments for the purpose of proving the above-mentioned contents.

FIGS. 3 through 7 are views that show the results of the experiments at this time.

Figure 3:
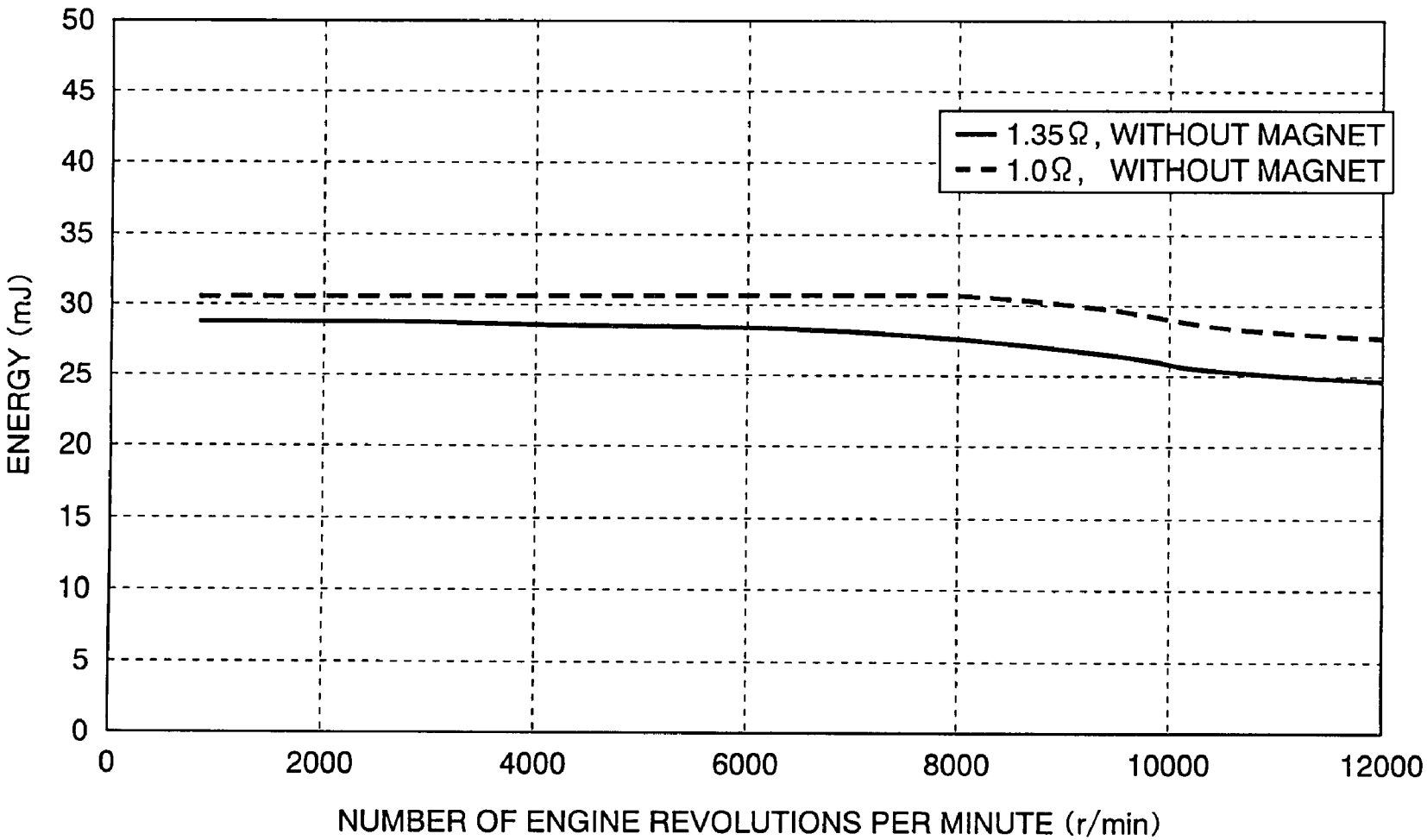
FIG. 3 is a characteristic view showing a relation between the number of engine revolutions per minute and discharge energy that was obtained by the inventor of the present invention through experiments.

FIG. 3 shows a first example of the ignition coil apparatus in which the resistance $R_1$ of the primary winding 12 is 1.35 Ω without the provision of the magnets 20, and a second example thereof in which the resistance $R_1$ of the primary winding 12 is 1.0 Ω without the provision of the magnets 20 in comparison with each other.

As can be seen from FIG. 3, in the second example in comparison with the first example, discharge energy became only about 6 to 7 mJ higher, in a high rotation number region of 8,000 rpm or more, than that in the first example, and only about 3 to 4 mJ higher than that in the first example in the low rotation number region.

Upon checking the rising waveform of the primary current, it has been found that the rising speed of the primary current $i_1$ increases until when the primary current $i_1$ is equal to or less than about 5 A, but the magnetic energy accumulated in the center core 2 exceeds its capacity thereby to cause a magnetic saturation phenomenon when the primary current $i_1$ becomes 5A or above. Accordingly, it is considered that the rising width or amount of discharge energy is lower in the low rotation number region, in which a maximum primary current value can be obtained and the primary interruption current value is large, than that in the high rotation number region in which the primary interruption current value is small.

Figure 4:
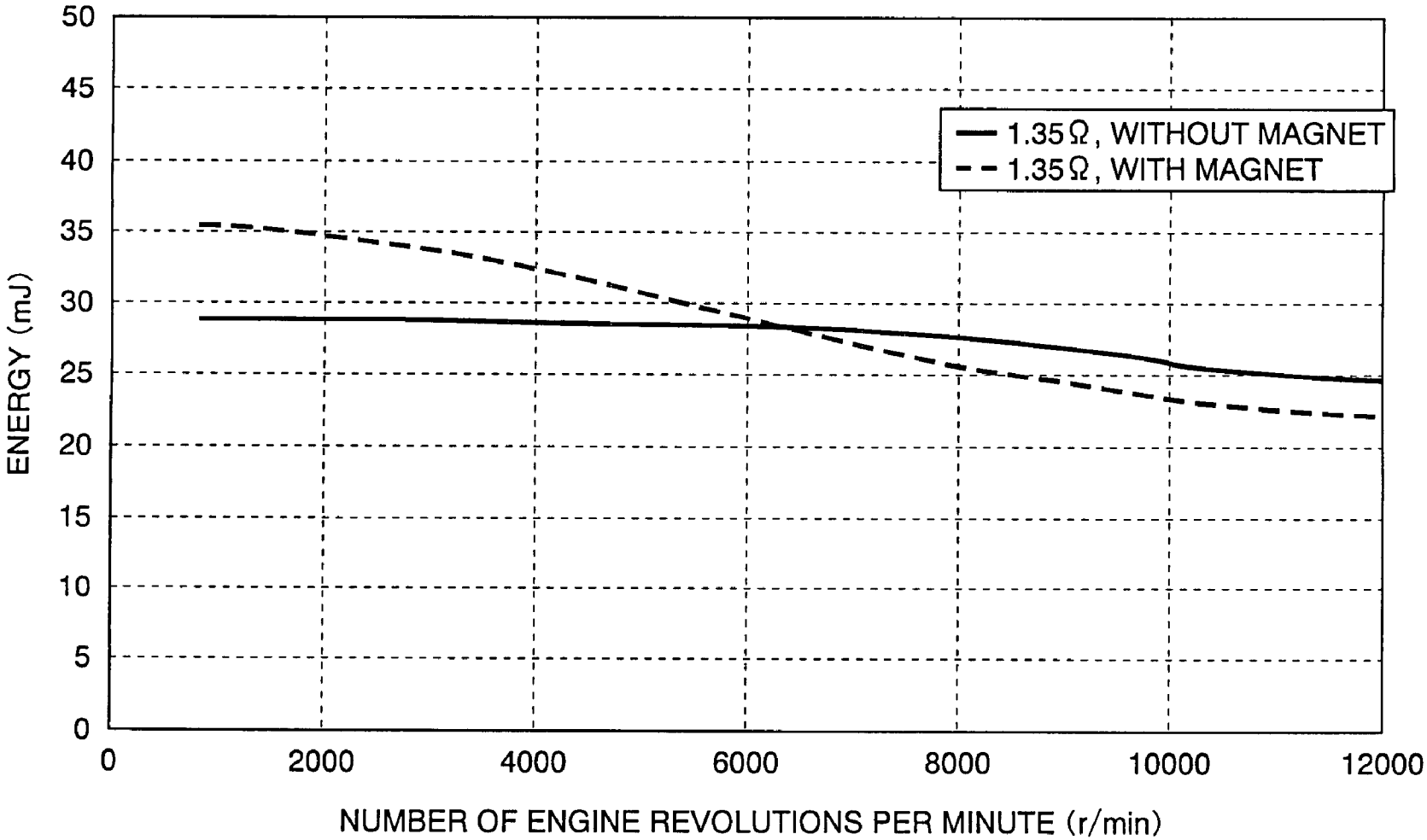
FIG. 4 is a characteristic view showing another relation between the number of engine revolutions per minute and discharge energy that was obtained by the inventor of the present invention through experiments.

FIG. 4 shows the first example in which the resistance $R_1$ of the primary winding 12 is 1.35 Ω without the provision of the magnets 20, and a third example in which the resistance $R_1$ of the primary winding 12 is 1.35 Ω with the provision of the magnets 20 in comparison with each other.

As can be seen from FIG. 4, in the third example in comparison with the first example, discharge energy is high and hence ignition performance is high in the low rotation number region, but there appears a phenomenon in which this relation is reversed when the rotation speed of the engine becomes 6,000 rpm or higher.

Figure 5:
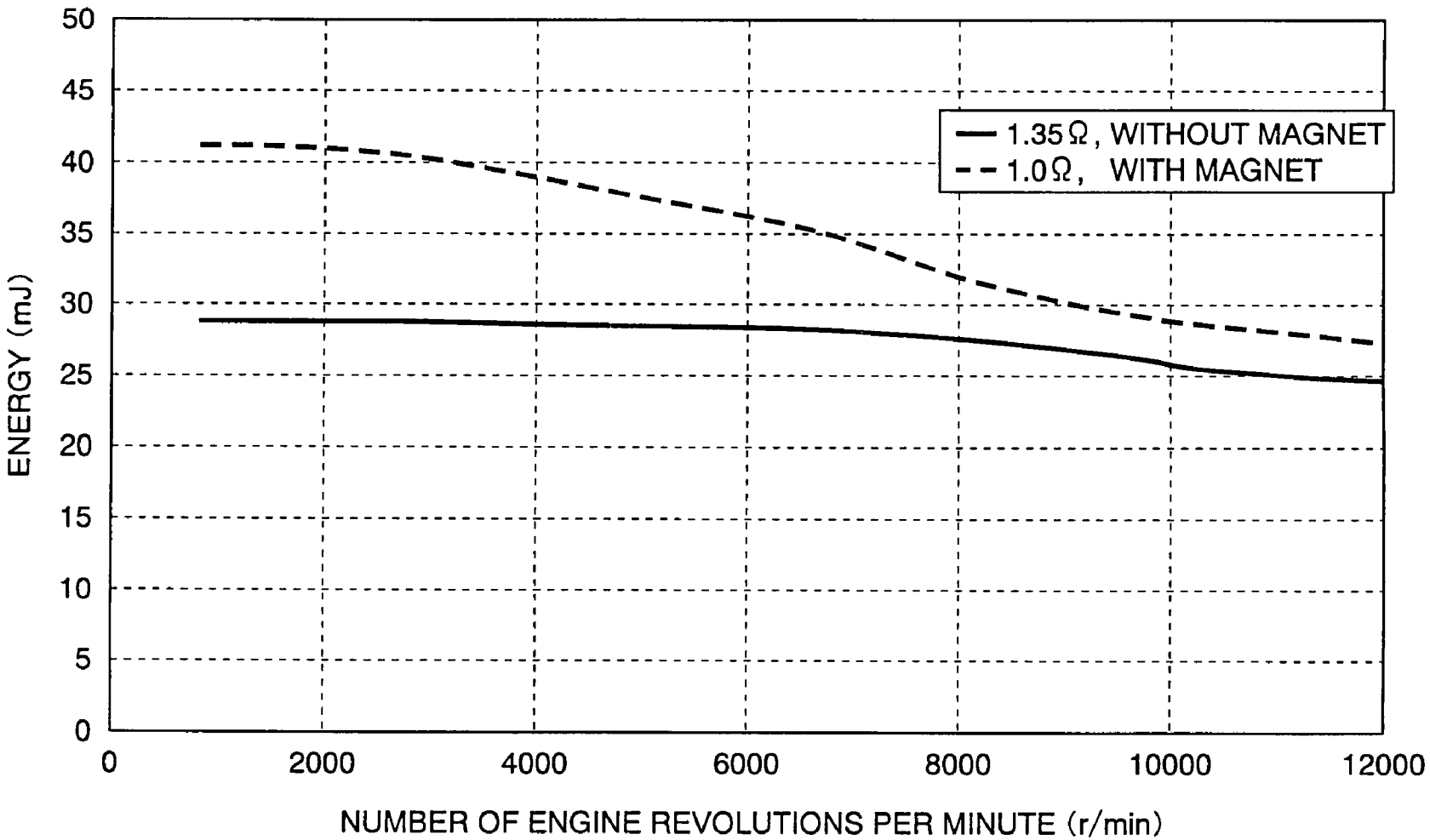
FIG. 5 is a characteristic view showing a further relation between the number of engine revolutions per minute and discharge energy that was obtained by the inventor of the present invention through experiments.

FIG. 5 shows the first example in which the resistance $R_1$ of the primary winding 12 is 1.35 Ω without the provision of the magnets 20, and a fourth example in which the resistance $R_1$ of the primary winding 12 is 1.0 Ω with the provision of the magnets 20 in comparison with each other.

The fourth example is the ignition coil apparatus according to this first embodiment in which, in comparison with the first example, the number of turns of the conductor is the same as that of the first example, but the wire diameter of the primary winding 12 is larger than that of the first example, and the magnets 20 are arranged at the opposite end faces of the center core 2.

From FIG. 5, it is found that in comparison with the first example, the fourth example is higher in the discharge energy than the first example in the entire rotation number region of the engine, and hence ignition performance is improved.

Figure 6:
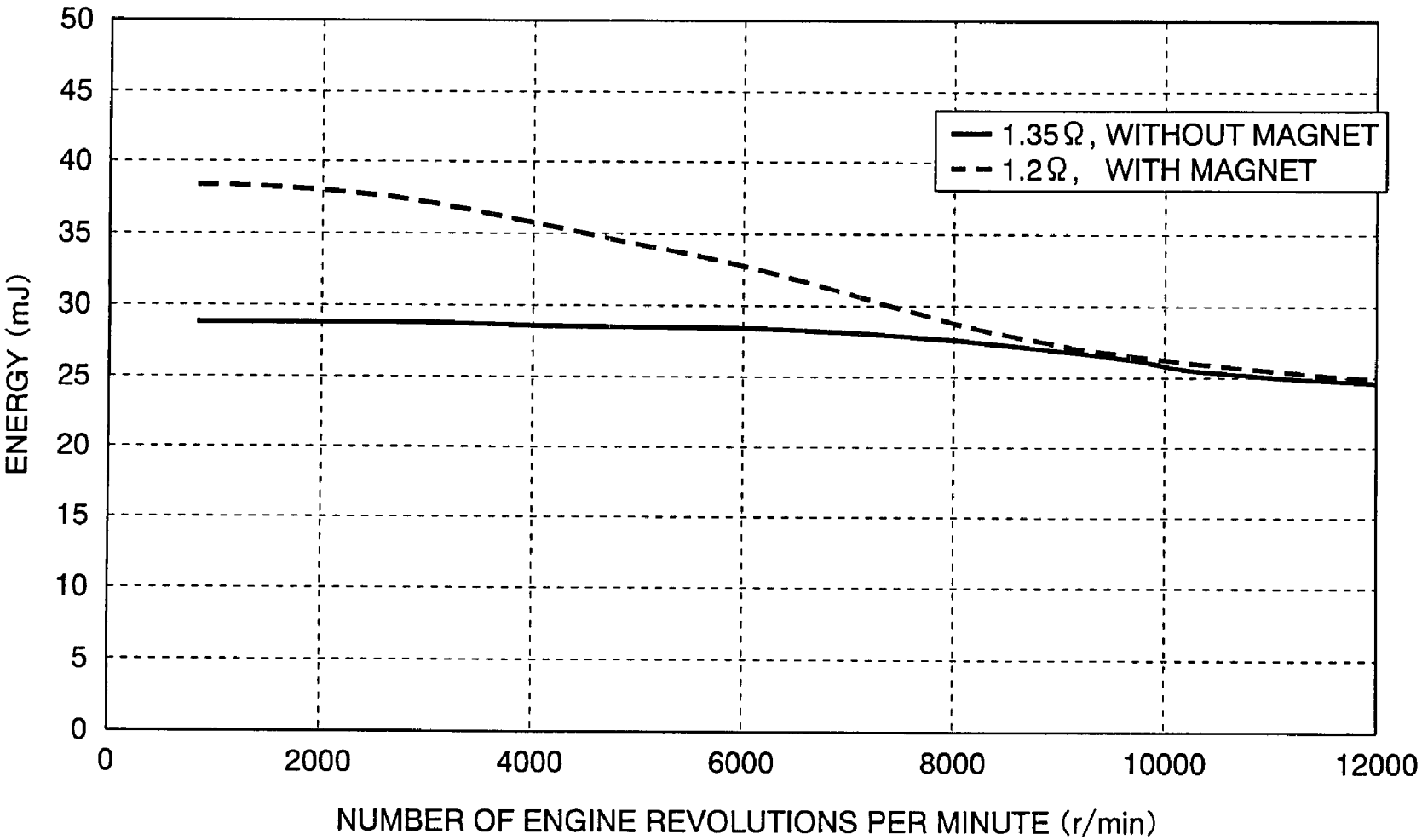
FIG. 6 is a characteristic view showing a further relation between the number of engine revolutions per minute and discharge energy that was obtained by the inventor of the present invention through experiments.

FIG. 6 shows the first example in which the resistance $R_1$ of the primary winding 12 is 1.35 Ω without the provision of the magnets 20, and a fifth example in which the resistance $R_1$ of the primary winding 12 is 1.20 Ω with the provision of the magnets 20 in comparison with each other.

From FIG. 6, it is found that when a comparison is made between the discharge energy in the first example and that in the fifth example, the discharge energy in the fifth example is higher than that in the first example in the entire rotation number region of the engine though the former becomes close to the latter in a range in which the engine speed or rotation is from 9,500 to 12,000 rpm.

Figure 7:
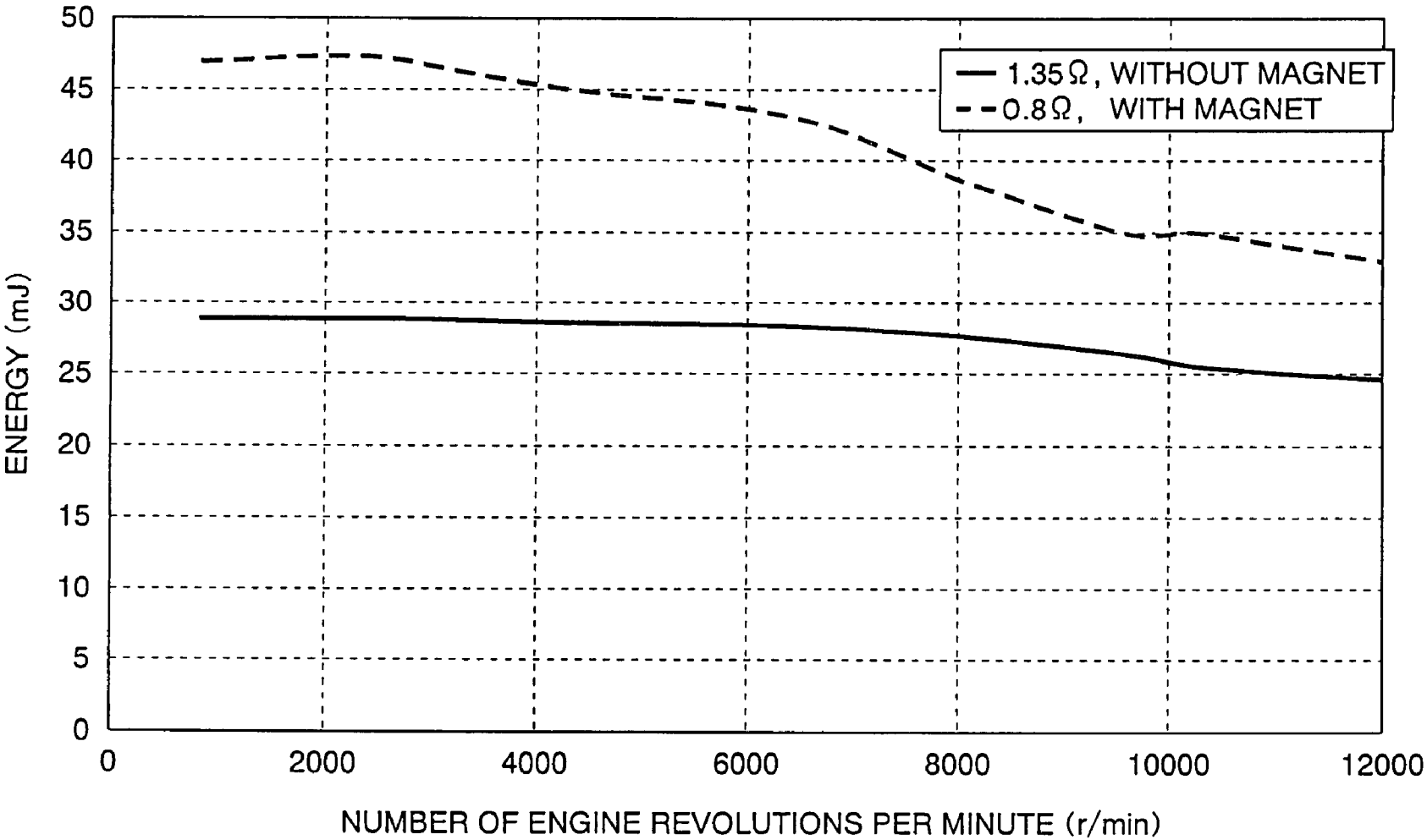
FIG. 7 is a characteristic view showing a further relation between the number of engine revolutions per minute and discharge energy that was obtained by the inventor of the present invention through experiments.

FIG. 7 shows the first example in which the resistance $R_1$ of the primary winding 12 is 1.35 Ω without the provision of the magnets 20, and a sixth example in which the resistance $R_1$ of the primary winding 12 is 0.80 Ω with the provision of the magnets 20 in comparison with each other.

From FIG. 7, it is found that when a comparison is made between the discharge energy in the first example and that in the sixth example, it is found that the sixth example is higher in the discharge energy and larger in the rising width or amount thereof than the first example in the entire rotation number region of the engine, as can be seen from a comparison with FIG. 6.

From the above-mentioned experimental results, it is found that in the case of the ignition coil apparatus having the magnets 20, the discharge energy is raised in the entire rotation number region of the engine by suppressing the resistance $R_1$ of the primary winding 12 to 1.20 or less.

Thus, while by reducing the resistance $R_1$ of the primary winding 12, the accordingly larger primary current $i_1$ can be supplied to the primary winding 12, and the heat generation of the primary coil 3 can be suppressed low, it is necessary to consider the constraint of space due to the increased wire diameter of the conductor of the primary winding 12 and the rating of the control circuit part 17.

That is, in order to ensure satisfactory discharge performance, it is necessary to ensure a predetermined number of turns of the conductor of the primary coil 3, but the increase of the wire diameter results in an accordingly increased diametral dimension of the ignition coil apparatus.

The ignition coil apparatus of this embodiment is an ignition coil apparatus of the full transistor type that is arranged in the plug hole, and the maximum value of the wire diameter of the conductor of the primary coil 3 is limited from the constraint of the space (e.g., an inner diameter of 24 mm) of the plug hole.

In addition, the primary current $i_1$ supplied to the primary winding 12 can be increased, so the rating of the control circuit part 17 can be accordingly increased by an amount of the current $i_1$ thus increased. As a result, there arise needs to raise heat dissipation as well as to add a current limiting circuit for the protection of the control circuit part 17.

As can be seen from FIG. 7 that shows the present experimental results, it has been found that when the value of the resistance $R_1$ of the primary winding 12 is about 0.8 Ω, the ignition performance of the engine including a motor cycle engine of the high rotation number type is improved in the entire range of the number of revolutions per minute of the engine, and the problems as referred to above can also be cleared by setting the lower limit of the resistance value to 0.8 Ω.

Specifically, in this ignition coil apparatus, by setting the resistance $R_1$ of the primary winding 12 to a value within a range of 0.8–1.2 Ω, it is possible to improve the ignition performance of the engine in the entire range (e.g., 0–12,000 rpm) of the number of revolutions per minute of the engine. In addition, the ignition coil apparatus can be received in the existing plug hole, and there is no need to provide a current limiting circuit to the control circuit part 17 that is separately arranged outside of the case 1, so the ignition performance and the diametral dimension of the ignition coil apparatus can be balanced in an optimal manner, thus making it possible to suppress the cost of manufacture to a low level.

As described in the foregoing, according to the ignition apparatus for an internal combustion engine of this embodiment, the magnets 20 are arranged on the opposite end faces, respectively, of the center core 2 for applying a magnetic force thereto in a direction opposite to the direction of the magnetic flux lines generated when the primary current $i_1$ is supplied to the primary coil 3, and at the same time, the upper limit value of the resistance of the primary coil 3 is set to 1.2 Ω. With such an arrangement and setting, the ignition performance of the engine can be improved in the entire range (e.g., 0–12,000 rpm) of the number of revolutions per minute of the engine.

In addition, since the lower limit value of the resistance of the primary coil 3 is set to 0.80 Ω, the ignition coil apparatus can be received in the existing plug hole, and there is no need to specially provide a current limiting circuit for protection of the power transistor to the control circuit part 17.

Moreover, since the primary coil 3 is arranged inside of the secondary coil 4, the diametral dimension of the primary coil 3 can be reduced as compared with the case in which the primary coil 3 is arranged outside of the secondary coil 4, and the total length of the conductor with a predetermined number of turns wound around the primary bobbin 11 can be shortened, so it is possible to reduce the resistance $R_1$ of the primary winding 12 in an easy manner.

Further, the control circuit part 17 for controlling the primary current supplied to the primary coil 3 is separately arranged outside of the case 1, so the influence by the heat generation of the control circuit part 17 itself can be suppressed.

While the invention has been described in terms of a preferred embodiment, those skilled in the art will recognize that the invention can be practiced with modifications within the spirit and scope of the appended claims.

What is claimed is:

1. An ignition coil apparatus for an internal combustion engine which is arranged in a plug hole formed in said internal combustion engine, said apparatus comprising:

a case, a center core arranged on a central axis of said case;

a primary coil and a secondary coil both arranged on an outer periphery of said center core, wherein said primary coil has a resistance, an upper limit value of which is 1.2 Ω; and a magnet, which is arranged on at least one of opposite end faces of said center core for applying a magnetic force thereto in a direction opposite to the direction of magnetic flux lines generated when a primary current is supplied to said primary coil.

2. The ignition coil apparatus for an internal combustion engine as set forth in claim 1, wherein the resistance of said primary coil has a lower limit value of 0.80 Ω.

3. The ignition coil apparatus for an internal combustion engine as set forth in claim 1, wherein said primary coil is arranged inside of said secondary coil.

4. The ignition coil apparatus for an internal combustion engine as set forth in claim 1, wherein a control circuit part for controlling the primary current supplied to said primary coil is separately arranged outside of said case.

5. The ignition coil apparatus for an internal combustion engine as set forth in claim 1, wherein the said primary coil has a high primary current interruption value without requiring a current limiting circuit.

* * * * *